US005214948A

United States Patent [19]

Sanders et al.

[11] Patent Number: 5,214,948

[45] Date of Patent: Jun. 1, 1993

[54] FORMING METAL PARTS USING SUPERPLASTIC METAL ALLOYS AND AXIAL COMPRESSION

[75] Inventors: Daniel G. Sanders, Seattle, Wash.; Bruce M. Burg, Louisville, Colo.

[73] Assignee: The Boeing Company, Seattle, Wash.

[21] Appl. No.: 812,137

[22] Filed: Dec. 18, 1991

[51] Int. Cl.[5] ..... B21D 26/02

[52] U.S. Cl. ..... 72/58; 72/59; 72/62

[58] Field of Search ..... 72/57, 58, 60, 61, 62, 72/900, 59

[56] References Cited

U.S. PATENT DOCUMENTS

| | | | |
|---|---|---|---|
| 1,835,314 | 12/1931 | Lord . | |
| 2,773,538 | 12/1956 | DeMers | 153/73 |
| 3,335,590 | 8/1967 | Early | 72/58 |
| 3,340,101 | 9/1967 | Fields, Jr. et al. | 148/11.5 |
| 3,394,569 | 7/1968 | Smith | 72/56 |
| 3,487,668 | 7/1970 | Fuchs, Jr. | 72/55 |
| 3,564,886 | 2/1971 | Nakamura | 72/62 |
| 3,611,768 | 10/1971 | Odagaki | 72/58 |
| 3,895,436 | 7/1975 | Summers et al. | 228/157 |
| 3,896,648 | 7/1975 | Schertenleib | 72/61 |
| 3,974,675 | 8/1976 | Tominaga | 72/56 |
| 4,045,986 | 9/1977 | Laycock et al. | 72/60 |
| 4,265,102 | 5/1981 | Shimakata et al. | 72/58 |
| 4,266,416 | 5/1981 | Festag et al. | 72/60 |
| 4,354,369 | 10/1982 | Hamilton | 72/38 |
| 4,414,834 | 11/1983 | Gratzer et al. | 72/58 |
| 4,437,326 | 4/1984 | Carlson | 72/62 |
| 4,584,860 | 4/1986 | Leonard | 72/61 |
| 4,644,626 | 2/1987 | Barnes et al. | 29/421 R |
| 4,936,128 | 6/1990 | Story et al. | 72/709 |
| 5,097,689 | 3/1992 | Pietrobon | 72/58 |

FOREIGN PATENT DOCUMENTS

| | | | |
|---|---|---|---|
| 0049735 | 3/1986 | Japan | 72/58 |
| 1433582 | 10/1988 | U.S.S.R. | 72/58 |

*Primary Examiner*—David Jones

*Attorney, Agent, or Firm*—Dellett, Smith-Hill and Bedell

[57] ABSTRACT

A method for forming metal parts from superplastic metal alloys uses axial compression of the blank starting material. A blank of the superplastic metal alloy is enclosed within a die press. The blank is generally tubular, although not necessarily circular, and has an aperture at each end. The ends of the blank are enclosed within correspondingly shaped sections of a cavity within the die press, while the center of the blank is disposed within a central cavity defining a desired shape of the metal part to be formed. Each end of the blank is then sealed with a ram or stop member, and the die press and blank are heated to a forming temperature that is within the superplastic temperature range of the metal alloy. Gas is supplied under pressure to the inside of the blank to produce an outward pressure urging the blank to deform outwardly within the central cavity of the die press. The blank is simultaneously compressed axially with one or both of the rams or stops, to cause additional superplastic metal alloy to be supplied to the central cavity as the blank undergoes superplastic flowing, so that thinning of the blank is limited during the formation of the part. The pressures inducing the superplastic flowing and the rate of axial compression can be varied in different combinations to produce parts with a wide range of shapes and thicknesses. These procedures are preferably performed under preprogrammed direction by a computer to attain precise control and repeatability.

16 Claims, 8 Drawing Sheets (STEP 1)

(STEP 2)

(STEP 3)

(STEP 4)

(STEP 5)

FORMING METAL PARTS USING SUPERPLASTIC METAL ALLOYS AND AXIAL COMPRESSION

BACKGROUND OF THE INVENTION

This invention relates to metal working, and more particularly to metal working in the field of aircraft manufacturing utilizing metal alloys capable of superplastic behavior.

The use of superplastic metal alloys as part of a process for forming metal structures has been known for some time. The first U.S. patent to disclose superplastic metal working was U.S. Pat. No. 3,340,101 to Fields et al for "Thermoforming of Metals" (1967), hereby incorporated by reference. This patent explains the limitations of other methods and suggests the extreme deformability that can be attained using superplasticity.

U.S. Pat. No. 3,895,436 to Summers et al for "Forming Metals" (1975), hereby incorporated by reference, discloses a process for forming a metallic vessel, the process including the steps of forming an inflatable envelope of a superplastic metallic alloy, heating the envelope to within the temperature range for superplasticity, and applying a differential pressure between the interior and exterior of the envelope such that the envelope expands like a balloon.

U.S. Pat. No. 3,896,648 to Schertenleib for "Blow Molding Process for Container of Superplastic Alloy", hereby incorporated by reference, discloses a method in which, within a metal mold, a smoothed hollow cylinder of superplastic alloy with a bottom is preheated and partially inflated by the application of a first internal pressure, and then blown out to its final dimensions by a second, higher internal pressure.

U.S. Pat. No. 4,045,986 to Laycock et al for "Forming Ductile Materials" (1977), hereby incorporated by reference, discloses a process by which a sheet of ductile metallic superplastic alloy material is first forced by a pressure differential into a female portion of a preform mold, and then forced by a reversed pressure differential into conformity with a male portion of the mold which has advanced to press against the opposite side of the sheet.

U.S. Pat. No. 4,354,369 to Hamilton for "Method for Superplastic Forming", hereby incorporated by reference, discloses a method for eliminating or minimizing cavitation and voids in superplasticly formed parts by applying pressure to both sides of the material either during or after forming the part.

None of the above prior art patents for superplastic metal working appear to provide any means for preventing thinning of the superplastic material as it is expanded and deformed. Yet, thinning can be a very serious problem when the dimensions of a desired part must greatly exceed the dimensions of the blank piece of material from which it is to be formed.

A number of U.S. patents disclose one or another variation on the idea of applying axial compressive loading to a tubular work piece, while also using a liquid (or flowable solid) to raise the pressure inside the work piece, so that bulging or similar shaping of the work piece is accomplished without thinning of the material in the regions that are caused to bulge. For example, U.S. Pat. No. 3,974,675 to Tominaga for "Molding Device", hereby incorporated by reference, discloses a system in which a work piece is subjected to axial compression as it is caused to bulge by an instantaneously generated high hydraulic pressure.

SUMMARY OF THE INVENTION

In accordance with the invention, there is provided a method for forming metal parts from superplastic metal alloys using axial compression (loading) of the blank starting material to achieve previously unattainable part shapes. The method includes the preliminary step of enclosing a blank of the superplastic metal alloy within a die press. The blank is generally tubular, although not necessarily circular, and has an aperture at least one end. The ends of the blank are enclosed within correspondingly shaped sections of the die press, while the center of the blank is disposed within a central cavity defining a desired shape of the metal part to be formed. Each end of the blank is then sealed with a ram or stop member, and the die press and blank are heated to a forming temperature that is within the superplastic temperature range of the metal alloy. Gas is then supplied under pressure to the inside of the blank through an aperture in one of the rams to produce an outward pressure urging the blank to deform outwardly within the central cavity of the die press. The blank is simultaneously compressed axially with one or both of the rams, to cause additional superplastic metal alloy to be supplied to the central cavity as the blank undergoes superplastic flowing, so that thinning of the blank is limited during the formation of the part. The pressures inducing the superplastic flowing and the rate of axial compression can be varied in different combinations to produce parts with a wide range of shapes and thicknesses. Gas can also be supplied to the cavity in the die press external to the blank to produce a back-pressure, the back-pressure being less than the outward pressure and thus permitting part formation while serving to limit cavitation or voids in the superplastic metal alloy. These procedures are preferably performed under preprogrammed direction by a computer to attain precise control and repeatability.

BRIEF DESCRIPTION OF THE DRAWINGS

For a better understanding of the invention, and to show how the same may be carried into effect, further reference will be made, by way of example, to the accompanying drawings in which.

In the different figures of the drawings, like reference numerals designate like components, and primed reference numerals designate components that have similar functions to those designated by the corresponding unprimed reference numerals.

DETAILED DESCRIPTION

Figure 1:
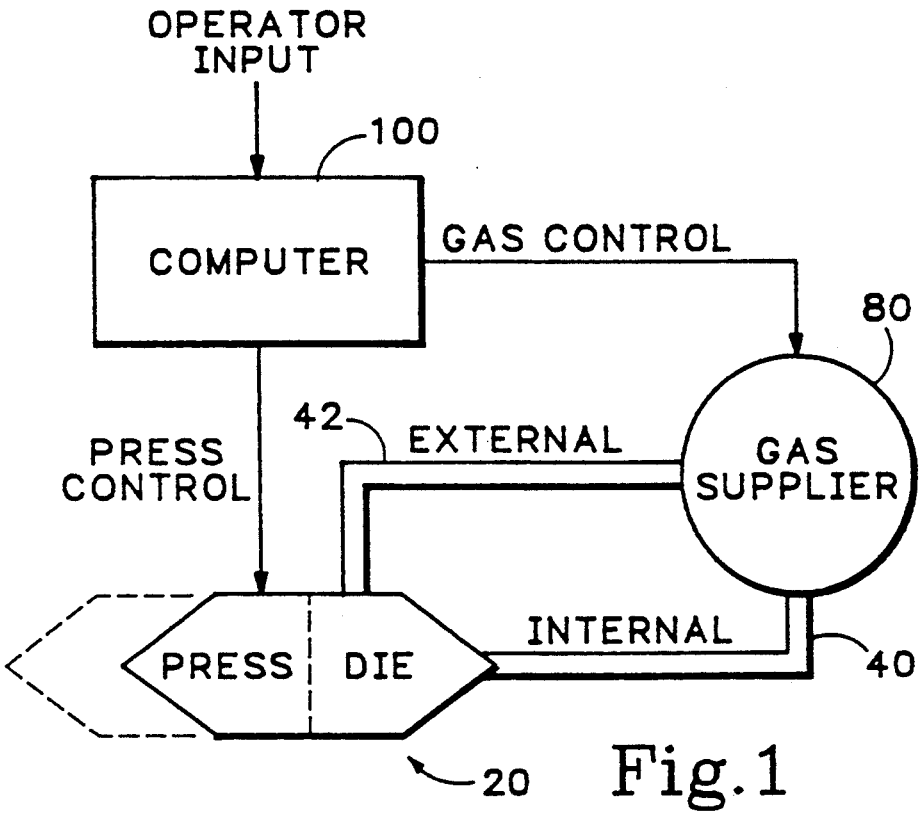
FIG. 1 is a block diagram of a system for practicing the method of the present invention.

Referring to FIG. 1, a computer 100 accepts operator input, and, according to that input, controls a gas supplier 80 and a die press 20 to practice the method of the present invention. The gas supplier 80 supplies pressurized inert gas, such as argon, to an internal part of the die press 20 via internal gas delivery tube 40 and to an external part of the die press 20 via external gas delivery tube 42. The operator input is a series of table entries, such as those shown in Table 1 below, that describe the desired amount of motion of the die press 20 and pressure supplied by the gas supplier 80 over time (cumulative).

TABLE 1

STEPS FOR PROCESSING EXAMPLE #1 (PRESS MOVEMENT) 7475 ALUMINUM, 0.125" THICK, TEMP. = 960° F.

| STEP NO. | TOTAL TIME (min.) | PRESS POSIT. (inches) | $P_{int}$ (psi) | $P_{ext}$ (psi) | $P_{diff}$ (psi) |
|---|---|---|---|---|---|
| 1 | 0 | 2.25 | 0 | 0 | 0 |
| 2 | 5 | 1.25 | 305 | 300 | 5 |
| 3 | 10 | 0.75 | 320 | 300 | 20 |
| 4 | 15 | 0.00 | 350 | 300 | 50 |
| 5 | 20 | 0.00 | 400 | 300 | 100 |
| 6 | 21 | 2.25 | 0 | 0 | 0 |

Figure 2A:
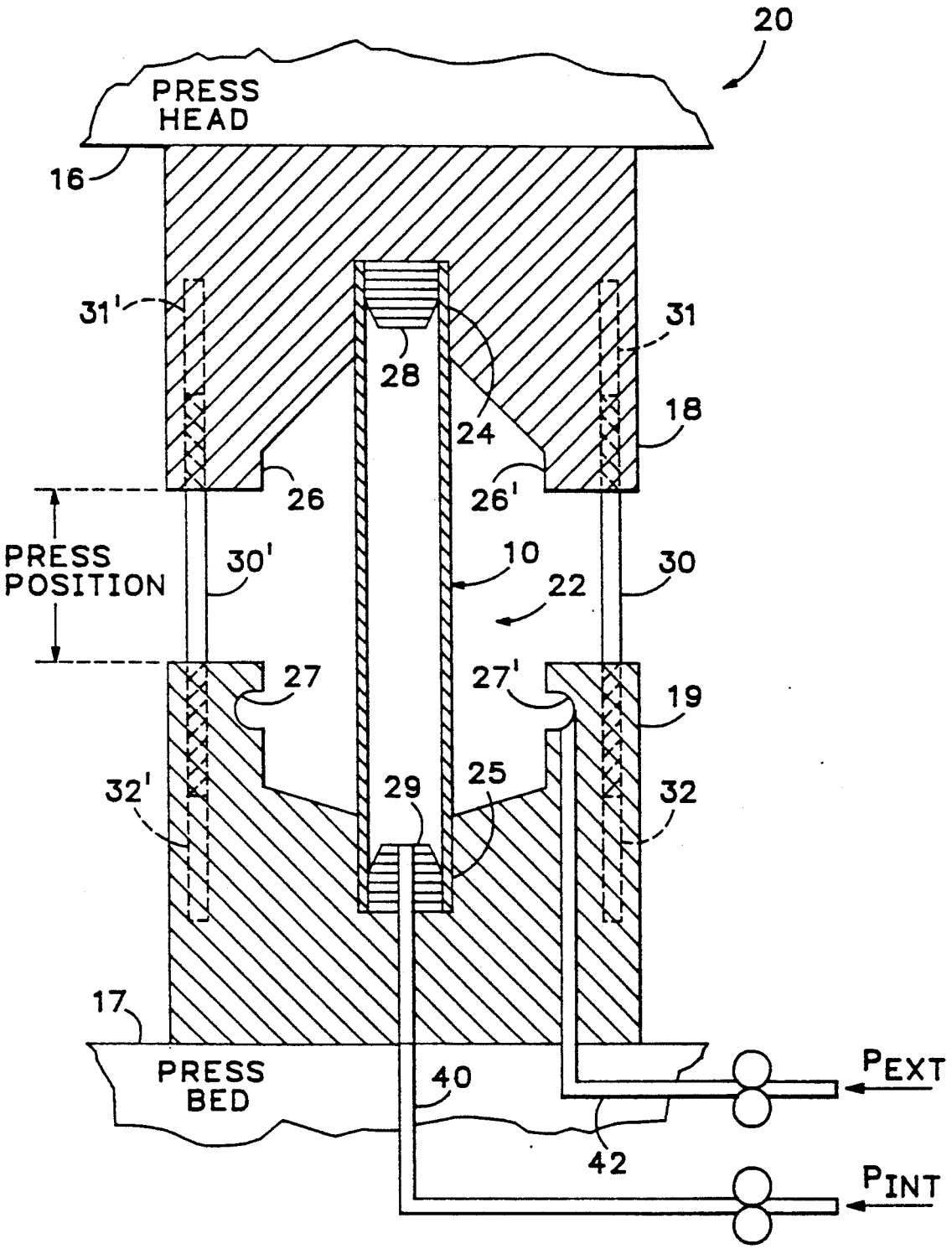
FIGS. 2A–2E are cross-sectional views of a die press forming a metallic part according to one embodiment of the present, invention.

Referring now to FIG. 2A, a die press 20 includes a top die member 18 and bottom die member 19 whose inner surfaces define a die cavity 22. The die cavity 22 has a top cylindrical part 24 and a bottom cylindrical part 25 into which there has been placed a blank 10 of superplastic metal alloy. The blank 10 of superplastic metal alloy fits snugly into the top and bottom parts 24,25 of the die cavity 22 and around top and bottom blank holding members 28,29. The die cavity also defines a wide middle cylindrical part 26 and widest bulge part 27.

The top and bottom die members 18,19 are connected by gas containment curtain 30 which fits into curtain holding slots 31 and 32 in the top and bottom die members 18 and 19, respectively. The curtain holding slots 31 and 32 are equipped with high temperature seals to retain gas under pressure. Gas under pressure is admitted to and withdrawn from the area inside of the blank 10 from the gas supplier 80 (FIG. 1) through internal gas delivery tube 40 according to the operator input to the computer 100 (FIG. 1). The top and bottom blank holding members 28 and 29 are equipped with O-rings that function as pressure seals.

To admit gas to and withdraw gas from the inside of the blank 10, the internal gas delivery tube 40 passes through the bottom blank holding member 29. Gas under pressure may also be admitted to or withdrawn from that part of the die cavity 22 which is outside of the blank 10 via internal gas delivery tube 42. To admit gas to and withdraw gas from that part of the die cavity 22 that is outside of the blank 10, the external gas delivery tube 42 connects to locations on the widest bulge part 27 of the die cavity 22 via holes that are much smaller than shown in this figure, so as to minimize protuberances that they might otherwise cause on the surface of the resulting parts.

Referring to FIG. 2A, the die press 20 is placed in a heated platen press, comprising a press head 16 and press bed 17, and is heated to a desired operating temperature. The blank 10 is placed in the die press 20 and is heated by heat transfer from the hot die press 20. Within one to two minutes the die press 20 and the blank 10 reach an equilibrium temperature of about 960° F. (515° C.). The top and bottom die members 18 and 19 are brought into sealing contact with the ends of the blank 10 of superplastic metal alloy, causing the facing surfaces of the top and bottom die members 18 and 19 to be separated by 2.25 inches (5.72 cm). No gas pressure has yet been applied to either portion of the die cavity 22.

Figure 2B:
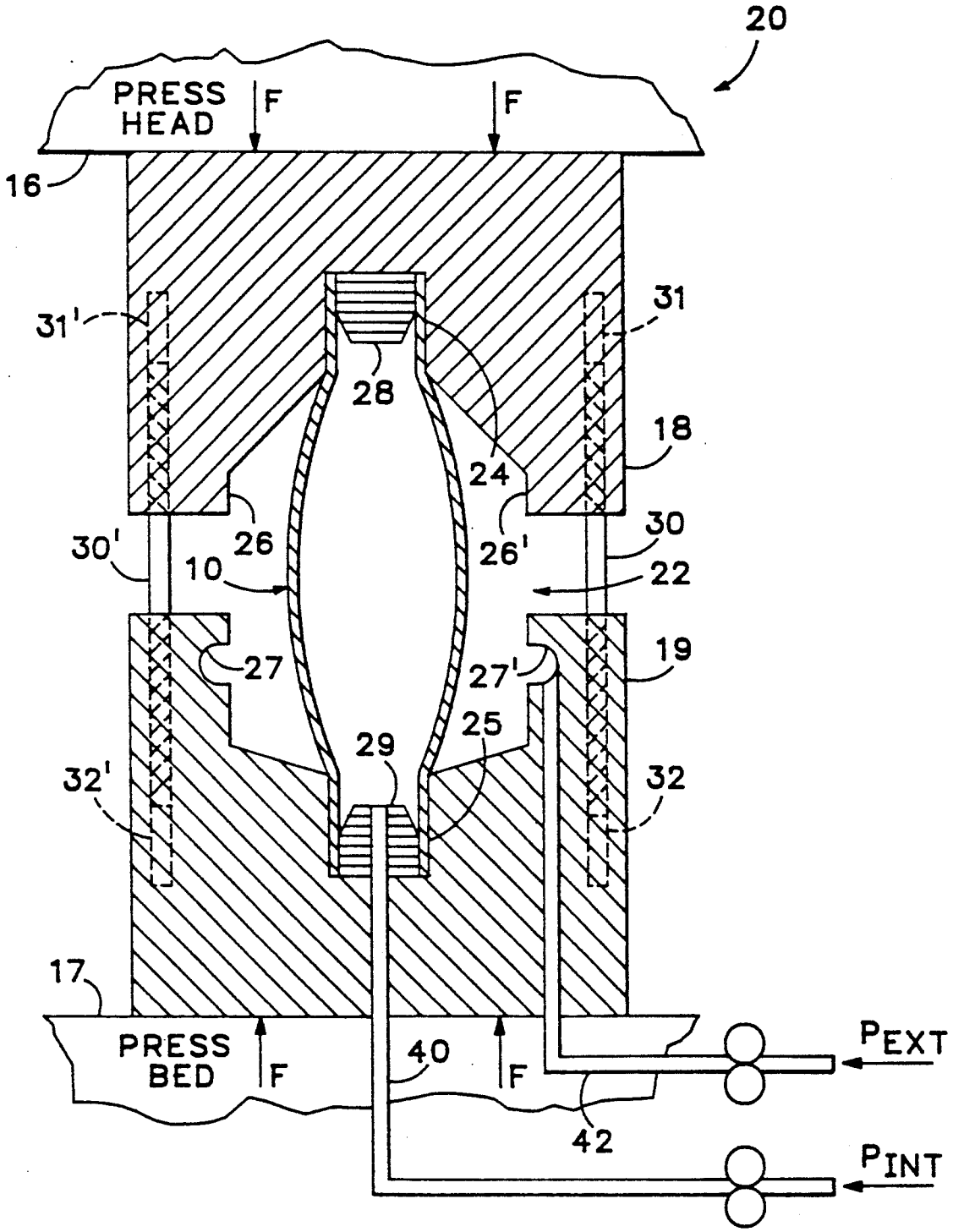

FIG. 2B illustrates the situation inside the die press 20 at STEP 2 in Example 1 (Table 1). Five minutes have now passed since the process started at STEP 1, and during that time the gas supplier 80 under the control of the computer 100 has linearly increased the pressure both inside and outside of the blank, until the external pressure is now 300 psi ($2.07\times10^6$ N/m$^2$) and the internal pressure is now 305 psi ($2.10\times10^6$ N/m$^2$). The resulting pressure difference of 5 psi ($3.45\times10^4$ N/m$^2$) is now exerting a mild outward force on the blank 10 of superplastic metal alloy. The combined effect of the internal and external pressures is to limit cavitation and voids in the superplastic metal alloy as the remaining steps are performed.

During this same five minute interval the press head 16 has been (linearly with time) forcing the top die member 18 downwardly, so that it has now moved downward a total of 1.00 inches (2.54 cm), causing the blank 10 to bulge outwardly, as shown in FIG. 2B, under the urging of the limited pressure difference of 5 psi ($3.45\times10^4$ N/m$^2$).

Figure 2C:
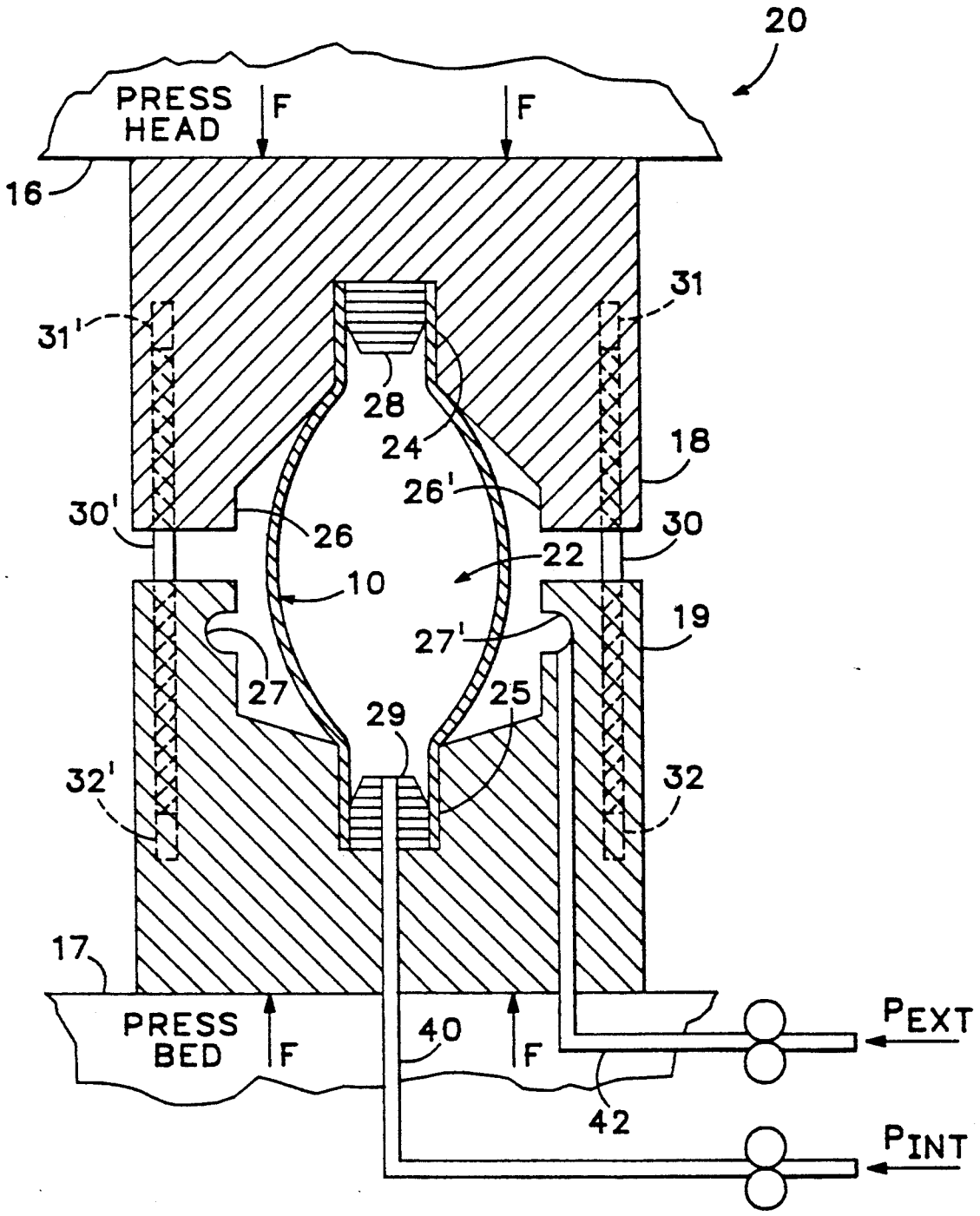

FIG. 2C shows the situation inside the die press 20 at STEP 3 in Example 1. Ten minutes have now passed since the beginning of the process at STEP 1, and five minutes have passed since STEP 2 discussed above. During that last five minutes, the internal pressure has been increased (linearly with time) to 320 psi ($2.21\times10^6$ N/m$^2$) while the external pressure has been held constant at 300 psi ($2.07\times10^6$ N/m$^2$), so that now the pressure difference from the inside of the blank to the outside is 20 psi ($1.38\times10^5$ N/m$^2$). Simultaneously, the press head 16 has continued (linearly with time) forcing the top die member 18 downwardly, so that it has now moved downward an additional 0.50 inches (1.27 cm) for a total of 1.50 inches (3.81 cm) of axial compression (loading). This compression, accompanied by the increased pressure differential, has thus caused the blank 10 to bulge further outward, to the shape shown in FIG. 2C.

Figure 2D:
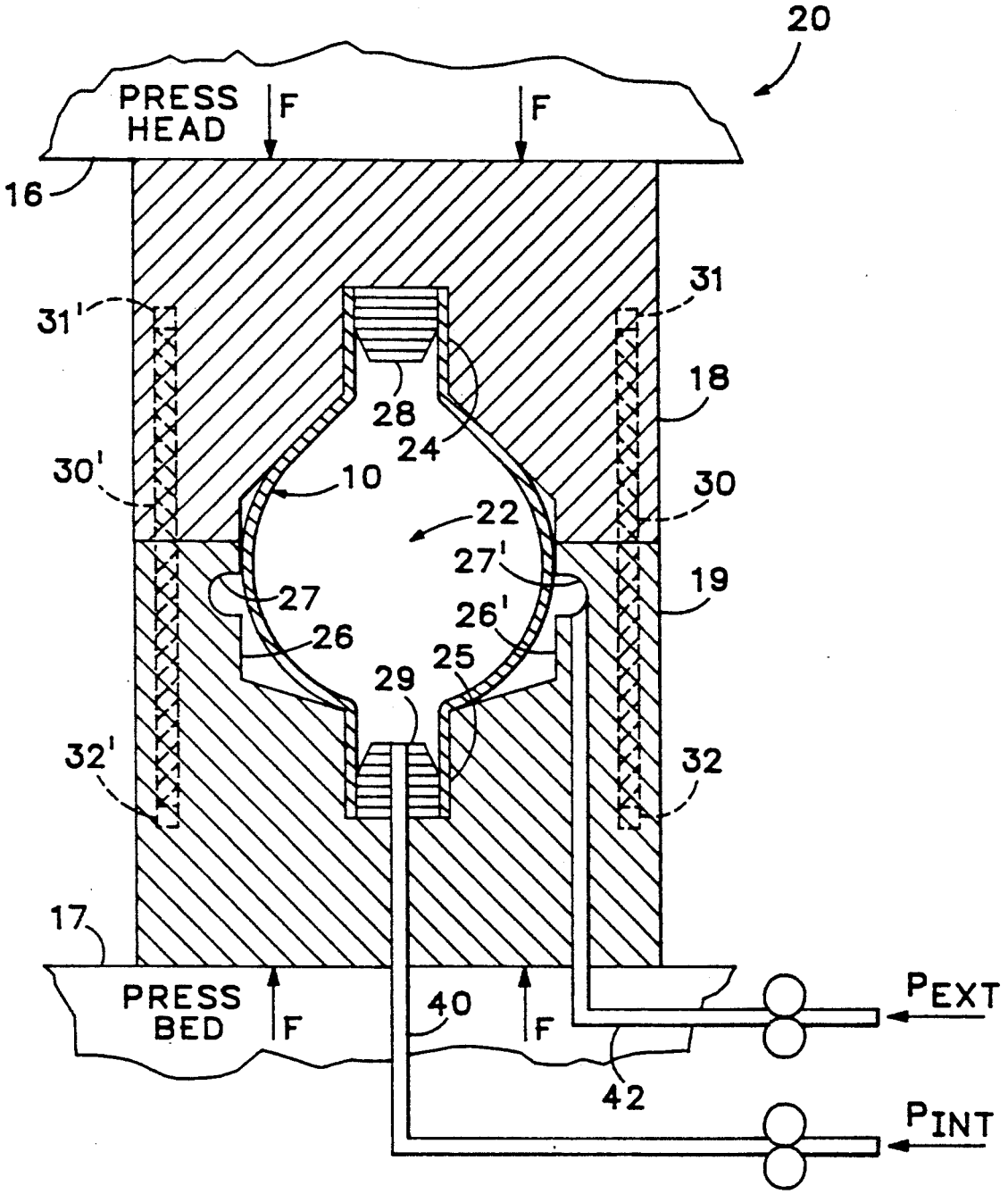

FIG. 2D illustrates the situation inside the die press 20 when the axial compression has been completed, as shown in STEP 4 of Example 1. Fifteen minutes have now passed since the beginning of the process at Step 1, and five minutes since STEP 3. During the last five minutes, the internal pressure has been increased (linearly with time) so that it is now 350 psi ($2.41\times10^6$ N/m$^2$) while the external pressure has been held constant at 300 psi ($2.07\times10^6$ N/m$^2$), so that now the pressure difference from the inside of the blank to the outside is 50 psi ($3.49\times10^5$ N/m$^2$). Simultaneously, the press head 16 has continued (linearly with time) forcing the top die member 18 downwardly, so that it has now moved downward an additional 0.75 inches (1.91 cm) for a total of 2.25 inches (5.72 cm) of axial compression. This compression, accompanied by the increased pressure differential, has thus caused the blank 10 to bulge further outward, to the shape shown in FIG. 2D.

Figure 2E:
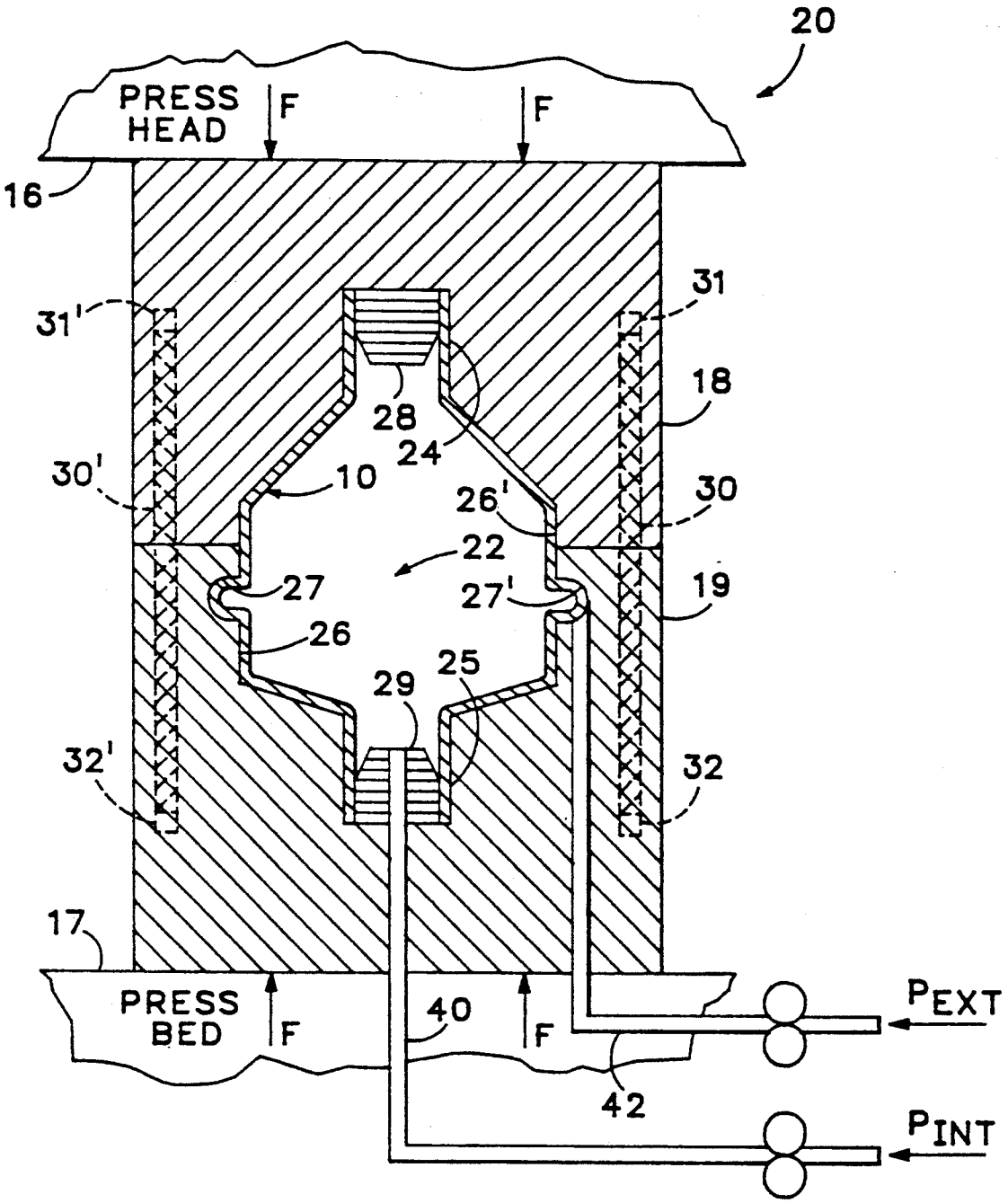

After STEP 4, during the time between STEPS 4 and 5, axial compression stops and superplastic flow completes the process of shaping the part, as illustrated in FIG. 2E. During the five minutes between these steps, the internal pressure is further increased (linearly with time) so that it is 400 psi ($2.76\times10^6$ N/m$^2$) by STEP 5, while the external pressure has again been held constant at 300 psi ($2.07\times10^6$ N/m$^2$), so that now the pressure differential from the inside of the blank to the outside has risen to 100 psi ($6.90\times10^5$ N/m$^2$), thereby causing effective superplastic flow, even into the widest bulge part 27 of the die cavity 22.

Over the one minute from STEP 5 until STEP 6, the pressure is reduced to one atmosphere in the die cavity 22 and both gas delivery tubes 40,42, i.e., the internal pressure, $P_{int}$, and the external pressure, $P_{ext}$, are reduced to zero pounds per square inch (relative to one atmosphere). After STEP 6 is reached, the finished part 10' is ready for removal from the die cavity 22 and a new blank installed.

Example #1, as shown in Table 1 and described above, processes a blank of 7475 Aluminum that is twelve inches long, three inches in diameter, and an eighth of an inch thick into a more complicated but axially symmetrical part that has a diameter that is greatly expanded in places. The resulting part 10' has had its length reduced by 19% relative to the blank 10 that it was formed from, but the diameter has been expanded by about 158% in one place and 133% over a considerable portion of its length. These expansions of diameter by about 158% and 133% were accomplished while only diminishing the thicknesses by 28% and 16%, respectively, as shown in Table 2. (Note that the "after" values shown in Table 2 are approximate and not as accurate as the precision with which they are described might suggest.)

TABLE 2

EXAMPLE #1: DIMENSIONS BEFORE & AFTER FORMING (INCHES)

| | Before | After | Ratio |
|---|---|---|---|
| Length | 12.00 | 9.75 | 0.81 |
| Neck Diameter | 3.00 | 3.00 | 1.00 |
| Wide Diameter | 3.00 | 7.00 | 2.33 |
| Bulge Diameter | 3.00 | 7.75 | 2.58 |
| Neck Wall Thickness | 0.125 | 0.125 | 1.00 |
| Taper Wall Thickness | 0.125 | 0.115 | 0.92 |
| Wide Wall Thickness | 0.125 | 0.105 | 0.84 |
| Bulge Wall Thickness | 0.125 | 0.090 | 0.72 |

The same die press 20 used to make the finished part 10' of 7475 Aluminum in Example #1 can also be used to make that same part of 6Al/4V Titanium in Example #2. The titanium blank is thinner and must be formed at a higher superplastic temperature, but because titanium does not cavitate or produce voids, no external pressure, $P_{ext}$, or gas containment curtain 30 is required. A higher pressure differential is used with titanium, and the forming process can be accomplished more quickly.

TABLE 3

STEPS FOR PROCESSING EXAMPLE #2 (PRESS MOVEMENT) 6 Al/4 V TITANIUM, 0.063" THICK, TEMP. = 1650° F.

| STEP NO. | TOTAL TIME (min.) | PRESS POSIT. (inches) | $P_{int}$ (psi) |
|---|---|---|---|
| 1 | 0 | 2.50 | 0 |
| 2 | 2 | 1.00 | 25 |
| 3 | 4 | 0.50 | 60 |
| 4 | 7 | 0.25 | 100 |
| 5 | 8 | 0.00 | 175 |
| 6 | 8:30 | 2.50 | 0 |

In the first step of the process for Example #2, STEP 1, the top and bottom die members 18 and 19 have been brought into sealing contact with the ends of the blank 10 of superplastic titanium alloy and the facing surfaces of the top and bottom die members 18 and 19 are separated by 2.50 inches (6.35 cm). No gas pressure has been supplied to the inside of the blank 10 yet, but the temperature of the die and blank have been raised to 1650° F. (900° C.).

In Example #2, the time required to go from STEP 1 to STEP 2 is two minutes, and during that time the internal gas pressure, $P_{int}$, which is now equal to the differential pressure, $P_{diff}$, has been linearly increased until the differential pressure is now 25 psi ($1.72\times10^5$ N/m$^2$). ($P_{diff}$ equals $P_{int}$ because $P_{ext}$ is 0 psi, or one atmosphere.) During this same two minute interval the press head 16 has been (linearly with time) forcing the top die member 18 downwardly, so that it has now moved downward a total of 1.50 inches (3.81 cm), causing the blank 10 to bulge outwardly, as shown in FIG. 2B, under the urging of the differential pressure and the compression axial load.

In the process of Example #2 STEP 3 is reached in four minutes. During the two minutes from STEP 2 to STEP 3, the differential pressure has been increased (linearly with time) to 60 psi ($4.14\times10^5$ N/m$^2$). Simultaneously, the press head 16 has continued (linearly with time) forcing the top die member 18 downwardly, so that it has now moved downward an additional 0.50 inches (1.27 cm) for a total of 2.00 inches (5.08 cm) of axial compression. This compression, accompanied by the increased pressure differential, has thus caused the blank 10 to bulge further outward, to the shape shown in FIG. 2C.

In Example #2, STEP 4 is reached three minutes after STEP 3, or seven minutes from the beginning of the process. The internal (and differential) pressure has been increased (linearly with time) further, so that it is now 100 psi ($6.90\times10^5$ N/m$^2$). Simultaneously, the press head 16 has continued (linearly with time) forcing the top die member 18 downwardly, so that it has now moved downward an additional 0.25 inches (0.64 cm) for a cumulative total of 2.25 inches (5.72 cm) of axial compression. This compression, accompanied by the increased pressure differential, has thus caused the blank 10 to bulge further outward, to a shape that is intermediate to those shown in FIGS. 2C and 2D.

After STEP 4, during the time between STEPS 4 and 5, axial compression is continued at an increased rate while the superplastic flow completes the process of shaping the part, as illustrated in FIG. 2E. During the one minute between these steps, the internal pressure is further increased (linearly with time) so that it reaches 175 psi ($1.21\times10^6$ N/m$^2$), thereby causing effective superplastic flow, even into the widest bulge part 27 of the die cavity 22.

Over the half minute from STEP 5 until STEP 6, the pressure, $P_{int}$, in the die cavity 22 is reduced to one atmosphere while the press is opened. After STEP 6 is reached, the finished part 10' is ready for removal from the die cavity 22 and a new blank may be installed.

Figure 3A:
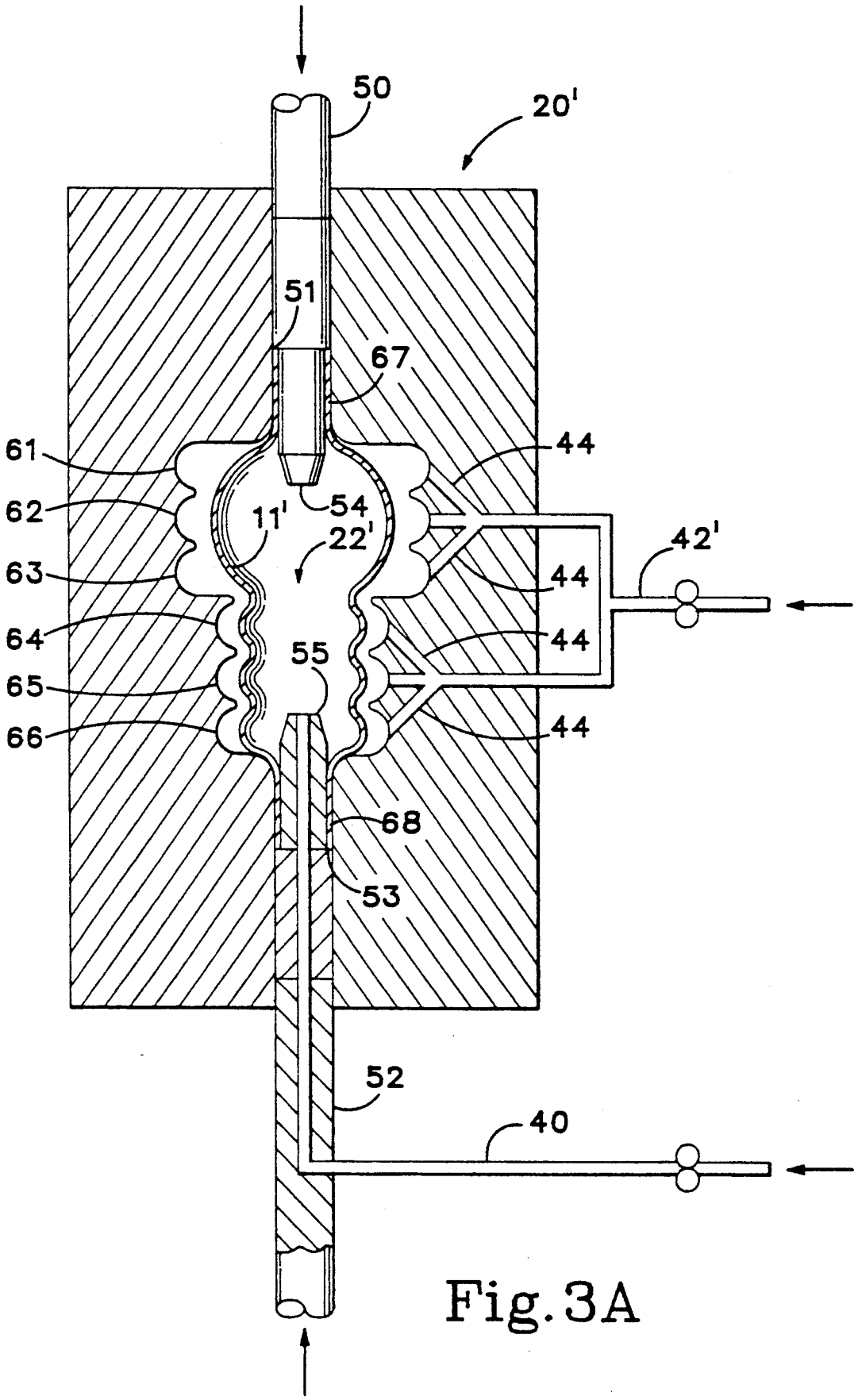
FIGS. 3A and 3B are cross-sectional views of a die press forming a metallic part according to another embodiment of the present invention.

Referring now to FIG. 3A, the principles of the present invention can also be used to form even more complex part shapes, such as the one defined by the die cavity 22' of die press 20'. Die cavity 22' defines a circular part shape that has three major bulges 61, 62 and 63, and three minor bulges 64, 65 and 66. Two neck regions 67 and 68 of additional blank 11 material are available for axial compression "feeding" of the blank 11 into the main portion of the die cavity 22'.

Die press 20' differs from the die press 20 shown above in connection with Examples #1 and #2 in that, in die press 20' the axial compressive loading can be applied at either or both ends of the blank 11 by first ram 50 and/or second ram 52. The rams 50,52 each have sealing surfaces 51,53 with high temperature O-rings that fit tightly against the ends of the blank 11 and tips that protrude through the neck regions 67 and 68 of the blank 11. The second (lower in FIGS. 3A and 3B) ram tip 55 includes an outlet for gas from the internal gas delivery tube 40. In this die press 20', the external gas delivery tube 42 is terminated in a plurality of branches 44 that terminated in each of the bulges 61,62,63 and 64,65,66. These external gas delivery tube branches 44 terminate in holes that are much smaller than they are shown in these figures, so as to minimize any protuberances that they might otherwise cause on the surface of the resulting parts.

Figure 3B:
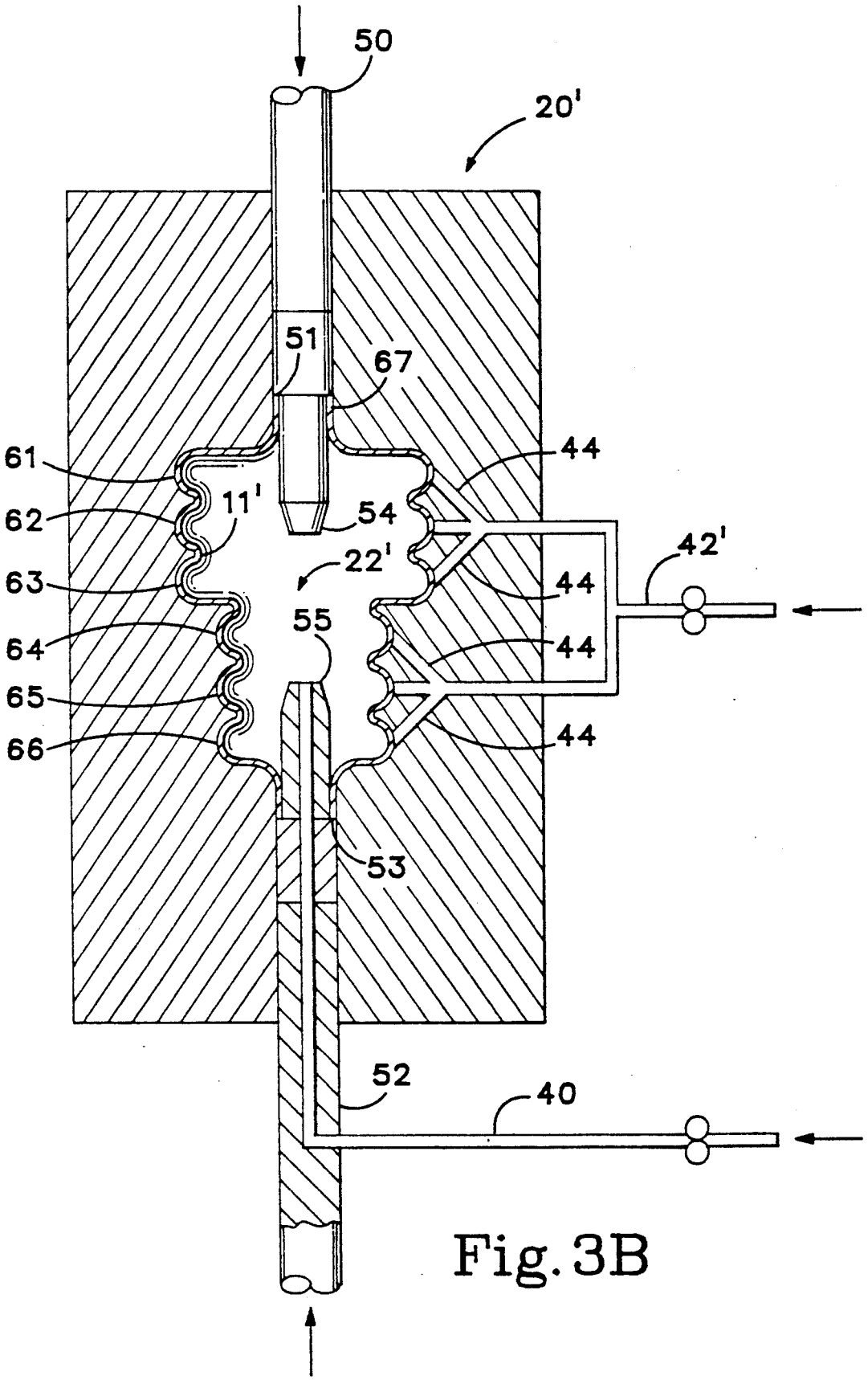

Table 4 shows the steps involved in a third example, Example #3, which uses 7475 Aluminum and the 960° F. temperature like Example #1, but this time in conjunction with the more complex part that is shaped by the die cavity 22' of the more complex die press 20' shown in FIGS. 3A and 3B. The portions of the die cavity 22' that define the boundaries between the different bulges 61,62,63 64,65,66 cannot be too sharp or they will serve to "cut" the blank 11 rather than shape it. However, a radius of about ⅛ inch (0.32 cm) has been found to be sufficient to prevent excessive thinning or tearing of the superplastic metal at these points.

TABLE 4

STEPS FOR PROCESSING EXAMPLE #3 (DOUBLE RAM MOVEMENT) 7475 ALUMINUM, 0.090" THICK, TEMP. = 960° F.

| STEP NO. | TOTAL TIME (min.) | RAM#1 POSIT. (inches) | RAM#2 POSIT. (inches) | $P_{int}$ (psi) | $P_{ext}$ (psi) | $P_{diff}$ (psi) |
|---|---|---|---|---|---|---|
| 1 | 0:00 | −6.0 | −6.0 | 0 | 0 | 0 |
| 2 | 0:30 | 0.0 | 0.0 | 0 | 0 | 0 |
| 3 | 2:00 | 0.0 | 0.0 | 300 | 300 | 0 |
| 4 | 8:00 | +1.5 | +1.0 | 350 | 300 | 50 |
| 5 | 12:00 | +2.75 | +1.5 | 400 | 300 | 100 |
| 6 | 13:00 | +2.75 | +1.5 | 0 | 0 | 0 |
| 7 | 14:00 | −6.0 | −6.0 | 0 | 0 | 0 |

Prior to STEP 1 of Example #3, the die cavity 22' has been loaded with a 16 inch long blank 11 of 7475 Aluminum tubing having a diameter of 3.00 inches (7.6 cm). In STEP 1 (not illustrated in any of the Figures) the first and second rams 50 and 52 are both positioned six inches further withdrawn from the blank 11 than they are shown in FIG. 3A. During the 30 second interval between STEP 1 and STEP 2 the rams 50 and 52 move into contact with blank 11, with their sealing surfaces 51 and 53 firmly pressed against the ends of the blank 11, but with insufficient force to cause any compression of the blank 11.

During the 90 seconds between STEPS 2 and 3, both the internal and external pressures are increased to 300 psi ($2.07\times10^6$ N/m') but the rams both remain stationary. Then, linearly, over the next six minutes from STEP 3 to STEP 4, the internal pressure and, consequently, the differential pressure are increased by 50 psi ($3.45\times10^5$ N/m$^2$) at the same time that the first ram 50 advances 1.5 inches (3.81 cm) into the die cavity 22' and the second ram 52 advances 1.0 inch (2.54 cm) into the die cavity 22'. This uneven feed of blank 11 material into the die cavity 22' compensates for the fact that the three major bulges 61,62,63 will ultimately require much more material than will the three minor bulges 64,65,66. At the time of STEP 4 the axially compressed and superplasticly flowed blank 11 looks approximately as shown in FIG. 3A.

During the next four minutes, between STEPS 4 and 5, the internal and differential pressure is increased linearly by another 50 psi ($3.45\times10^5$ N/m$^2$) bringing the total differential pressure to 100 psi ($6.90\times10^5$ N/m$^2$). During the same interval the first ram 50 advances another 1.25 inches (3.18 cm) and the second ram 52 advances another 0.5 inches (1.27 cm). Again, this uneven feed of material compensates for larger surface area of the major bulges 61,62,63 relative to the minor bulges 64,65,66. At the end of STEP 5 the new part 11' is fully formed, as shown in FIG. 3B. The dimensions that result from Example #3 are shown in Table 5.

During the minute between STEPS 5 and 6 both the internal and external pressures are reduced to zero (one atmosphere). Then, during the minute between STEPS 6 and 7, both rams 50 and 52 are withdrawn, and the newly formed part 11' is ready for removal from the die press 20'. Table 5 shows the dimensions of the new part and the ratios of compression and expansion between the part 11' and the blank 11.

TABLE 5

EXAMPLE #3: DIMENSIONS BEFORE & AFTER FORMING (INCHES)

| | Before | After | Ratio |
|---|---|---|---|
| Length | 16.00 | 11.75 | 0.73 |
| Minor Bulge Dia. | 3.00 | 5.00 | 1.67 |
| Major Bulge Dia. | 3.00 | 6.00 | 2.00 |
| Neck Thickness | 0.090 | 0.090 | 1.00 |
| Minor Bulge Thckns. | 0.090 | 0.065 | 0.72 |
| Major Bulge Thckns. | 0.090 | 0.060 | 0.67 |

To illustrate the advantages of this technique in reducing the amount of thinning that occurs in critical regions of a complex part, Table 6 is provided for comparison with Table 5 to show the amount of thinning that would have occurred using superplastic forming without the benefit of axial compression.

TABLE 6

DIMENSIONS BEFORE & AFTER USING SUPERPLASTIC FORMING ALONE (INCHES)

| | Before | After | Ratio |
|---|---|---|---|
| Minor Bulge Thckns. | 0.090 | 0.035 | 0.39 |
| Major Bulge Thckns. | 0.090 | 0.030 | 0.33 |

Table 7 provides yet another example of the method of the present invention, Example #4. This example uses yet another superplastic metal alloy, NAS 64 Stainless Steel. This material requires a superplastic temperature of 1700° F. (927° C.).

TABLE 7

STEPS FOR PROCESSING EXAMPLE #4 (DOUBLE RAM MOVEMENT) NAS 64 STAINLESS STEEL, 0.050" THICK, TEMP. = 1700° F.

| STEP NO. | TOTAL TIME (min.) | RAM#1 POSIT. (inches) | RAM#2 POSIT. (inches) | $P_{int}$ (psi) | $P_{ext}$ (psi) | $P_{diff}$ (psi) |
|---|---|---|---|---|---|---|
| 1 | 0 | −6.0 | −6.0 | 0 | 0 | 0 |
| 2 | 1 | 0.0 | 0.0 | 0 | 0 | 0 |
| 3 | 3 | 0.0 | 0.0 | 450 | 450 | 0 |
| 4 | 6 | +1.0 | +0.75 | 600 | 450 | 150 |
| 5 | 8 | +2.5 | +1.5 | 750 | 450 | 300 |
| 6 | 9 | +2.5 | +1.5 | 0 | 0 | 0 |
| 7 | 10 | −6.0 | −6.0 | 0 | 0 | 0 |

Prior to STEP 1 of Example #4, the die cavity 22' has been loaded with a 16" blank 11 of NAS 64 Stainless Steel. As in Example #3, in STEP 1 of Example #4 the first and second rams 50 and 52 are both positioned six inches further withdrawn from the blank 11 than they are shown in FIG. 3A. During the one minute interval between STEP 1 and STEP 2 the rams 50 and 52 move into contact with blank 11, with their sealing surfaces 51 and 53 firmly pressed against the ends of the blank 11, but with insufficient force to cause any compression of the blank 11.

During the two minutes between STEPS 2 and 3, both the internal and external pressures are increased to 450 psi ($3.10\times10^6$ N/m$^2$) but the rams both remain stationary. Then, linearly, over the next three minutes from STEP 3 to STEP 4, the internal pressure and, consequently, the differential pressure are increased by 150 psi ($1.03\times10^6$ N/m$^2$) at the same time that the first ram 50 advances 1.0 inch (2.54 cm) and the second ram 52 advances 0.75 inches (1.9 cm). As before, this uneven feed of blank 11 material into the die cavity 22' compensates for the fact that the three major bulges 61,62,63 will ultimately require much more material than will the three minor bulges 64,65,66. At the time of STEP 4 the axially compressed and superplasticly flowed blank 11 looks approximately as shown in FIG. 3A.

During the next two minutes, between STEPS 4 and 5, the internal and differential pressure is increased linearly by another 150 psi ($1.03\times10^6$ N/m$^2$) bringing the total differential pressure to 300 psi ($2.07\times10^6$ N/m$^2$). The stainless steel materials require the highest differential pressures to cause superplastic flow without the formation of cavities. During the interval from STEP 4 to STEP 5, the first ram 50 also advances another 1.5 inches (3.81 cm) while the second ram 52 advances another 0.75 inches (1.9 cm). Again, this uneven feed of material compensates for larger surface area of the major bulges 61,62,63 relative to the minor bulges 64,65,66. At the end of STEP 5 the new part 11' is fully formed, as shown in FIG. 3B.

During the minute between STEPS 5 and 6 both the internal and external pressures are reduced to zero (one atmosphere). Then, during the minute between STEPS 6 and 7, both rams 50 ad 52 are withdrawn, and the newly formed part 11' is ready for removal from the die press 20'.

While the four examples given above only use three different materials, there are numerous superplastic alloys suitable for use in commercial aircraft structures, the field within which this invention arose. The following is a partial list, along with their superplastic forming temperatures:

| Titanium = 1650° F. | Aluminum 800–1000° F. |
|---|---|
| PM 700 | 5083 |
| 6 Al/4 V | 7475 |
| CORONA 5 | PM 7064 |
| 6 Al/2 Sn/4 Zr/2 Mo | PM 7064/20 V % SiCp |
| 15 V/3 Cr/3 Sn/3 Al | PM D19 |
| 8 Al/1 Mo/1 V | 2004 (Supral 100, 150) |
| 3 Al/2.5 V | 2090 Al/Li |
| Al/2.5 V | 8090 Al/Li |
| Ti-1100 | 8091 Al/Li |
| Super-Alpha-2 | Supral 220 |
| Gamma TiAl | WELDALITE |
| Stainless Steel | Nickel 1700–1850° F. |
| 1650–1900° F. | INCO 718 |
| NAS 64 | In 100 |
| IN 744 | RSR 143 |
| AVESTA 2205 | RSR 185 |

-continued

| |
|---|
| Inconel 625 SP |

7475 Aluminum is preponderantly Aluminum, but also contains 5.2% to 6.2% Zinc, 1.9% to 2.6% Magnesium, 1.2% to 1.9% Copper, and 0.18% to 0.25% Chromium, and does not contain more than 0.15% of all other metals. As its name suggests, 6Al/4V Titanium is approximately 90% Titanium, but is alloyed with 6% Aluminum and 4% Vanadium.

While the examples provided to illustrate the invention have utilized circular blanks and die shapes with circular symmetry, there is no reason in principle why the invention is limited to such shapes. Similar results could be obtained for shapes, of both blanks and final products, that depart from annular axial symmetry, e.g. ovals or ellipses. Because the superplastic flow and axial compression can be orchestrated to permit extra flowing or supply extra material in different combinations, the method can be successfully adapted to produce metal parts with a wide variety of shapes and thicknesses. The thickness of different parts of the blanks can also be varied, either axially or angularly, to achieve different effects in the parts that result from the process.

While a preferred embodiment of the present invention has been shown and described, it will be apparent to those skilled in the art that many changes and modifications may be made without departing from the invention in its broader aspects. The claims that follow are therefore intended to cover all such changes and modifications as fall within the true scope of the invention.

We claim:

1. A method for forming metal parts from superplastic metal alloys, the method comprising the steps of:

heating to a superplastic temperature a blank of superplastic metal alloy and a die cavity of a die press containing the blank, the die press having first and second die members, the die cavity forming a desired shape of a finished part when the first die member is in a final position;

applying an internal superatmospheric pressure and an external superatmospheric pressure to an inside of the blank and an outside of the blank respectively to create a pressure differential wherein the greater pressure is inside of the blank;

axially compression the blank by moving the first die member toward the final position; and controlling a rate of applying and a rate of axially compressing to cause the blank to be formed into the desired shape of the finished part against the die cavity by a combination of axial compression and superplastic flowing.

2. A method according to claim 1 wherein the blank defines an aperture at one end thereof and the applying step comprises:

sealing said aperture with the second die member; and supplying fluid under pressure to the inside of the blank via a passage through said second die member.

3. A method according to claim 2 wherein the second die member has a second passage that opens at the outside of the blank and the applying sep comprises supplying fluid under pressure to the outside of the blank via said second passage.

4. A method according to claim 1 wherein the blank has first and second opposite ends and defines first and second apertures at its first and second ends respectively, and the applying step comprises:

sealing the first aperture with the first die member;

sealing the second aperture with the second die member; and supplying fluid under pressure to the inside of the blank via a passage through at least one of said die members.

5. A method according to claim 4 wherein said one die member has a second passage that opens at the outside of blank and the applying step comprises supplying fluid under pressure to the outside of the blank via said second passage.

6. A method according to claim 1 wherein the applying step comprises applying an external pressure of at least about 200 psi above atmospheric to the outside of the blank.

7. A method for forming metal parts from superplastic metal alloys, the method comprising the steps of:

heating to a superplastic temperature a blank of superplastic metal alloy and a die cavity of a die press containing the blank, the die cavity having a desired shape of a finished part;

applying an internal superatmospheric pressure and an external superatmospheric pressure to an inside of the blank and an outside of the blank respectively to create a pressure differential wherein the greater pressure is inside of the blank, the applying occurring at a controllable and variable rate;

feeding an additional portion of the blank into the die cavity by axial compression of the blank, the feeding occurring at a controllable and variable rate; and controlling the applying rate and the feeding rate to cause the blank to be formed into the desired shape of the finished part against the die cavity.

8. A method according to claim 7 wherein the feeding step comprises the step of moving one end of the blank toward a center of the die cavity with a ram.

9. A method according to claim 8 wherein the feeding step further comprises the step of also moving the other end of the blank toward the center of the die cavity with a second ram.

10. A method according to claim 7 wherein the blank defined an aperture at one end thereof and the applying step comprises:

sealing said aperture with a ram; and supplying fluid under pressure to the inside of the blank via a passage through said ram.

11. A method according to claim 10 wherein the feeding step comprises moving said one end of the blank toward a center of the die cavity with the ram.

12. A method according to claim 10 wherein the die press has a passage that opens at the outside of the blank and the applying step comprises supplying fluid under pressure to the outside of the blank via said passage in the die press.

13. A method according to claim 7 wherein the blank has first and second opposite ends and defines first and second apertures at its first and second ends respectively, and the applying step comprises:

sealing the first aperture with a first ram;

sealing the second aperture with a second ram; and supplying fluid under pressure to the inside of the blank via a passage through at least one of said rams.

14. A method according to claim 13 wherein the feeding step comprises moving said firs and second ends of the blank toward a center of the die cavity with the first and second rams.

15. A method according to claim 13 wherein the die press has a passage that opens at the outside of the blank and the applying step comprises supplying fluid under pressure to the outside of the blank via said passage in the die press.

16. A method according to claim 7 wherein the applying step comprises applying an external pressure of about 450 psi above atmospheric to the outside of the blank.

* * * * *